US007010815B2

(12) United States Patent
Tufano-Sisca

(10) Patent No.: US 7,010,815 B2
(45) Date of Patent: Mar. 14, 2006

(54) CAP FOR ENCIRCLING WEARER'S HAIR

(76) Inventor: Renee Tufano-Sisca, 38 Lynn Dr., Englewood Cliffs, NJ (US) 07632

( * ) Notice: Subject to any disclaimer, the term of this patent is extended or adjusted under 35 U.S.C. 154(b) by 78 days.

(21) Appl. No.: 10/672,855

(22) Filed: Sep. 26, 2003

(65) Prior Publication Data

US 2004/0128739 A1 Jul. 8, 2004

Related U.S. Application Data

(63) Continuation-in-part of application No. 10/292,083, filed on Nov. 12, 2002, now abandoned.

(51) Int. Cl.
*A42B 1/24* (2006.01)

(52) U.S. Cl. ..... 2/209.3; 2/171.5; 2/172

(58) Field of Classification Search ..... 2/171.1, 2/171.5, 171.6, 171.7, 171.8, 172, 182.3, 2/195.1
See application file for complete search history.

(56) References Cited

U.S. PATENT DOCUMENTS 2,988,747 A * 6/1961 Stofle ..... 2/174
D296,496 S * 7/1988 Kang ..... D2/877
4,815,148 A * 3/1989 Satterfield ..... 2/195.1
5,321,854 A * 6/1994 Kronenberger ..... 2/209.7
D424,282 S * 5/2000 Crumpton et al. ..... D2/876
6,202,219 B1 * 3/2001 Cheever ..... 2/195.2
6,401,255 B1 * 6/2002 Douglas ..... 2/207

* cited by examiner

*Primary Examiner*—Katherine M. Moran
(74) *Attorney, Agent, or Firm*—Roger M. Rathbun

(57) ABSTRACT

A baseball type cap to be worn by a person constructed of a flexible material with a visor extending frontward and a pair of rearwardly extending, generally triangular shaped flaps that both have elongated inner edges and lower edges. In one embodiment, the lower edges of the flaps are adapted to be affixed together by an elongated securing system, such as a hook and loop system available under the trademark Velcro. In affixing the lower edges together, flaps are substantially overlapped and the crown of the cap is formed with a small opening formed at or near the crown to encircle the person's hair that can easily be directed through the opening and controlled to pass upwardly and rearwardly of the person to keep the hair off the nape of the neck of the person. The cap can thereby be easily donned by the person and provide control of the hair.

13 Claims, 3 Drawing Sheets

CAP FOR ENCIRCLING WEARER'S HAIR

REFERENCE TO RELATED APPLICATIONS

This application is a continuation-in-part of U.S. patent application Ser. No. 10/292,083 filed Nov. 12, 2002, now abandoned and entitled CAP FOR ENCIRCLING WEARER'S HEAD.

BACKGROUND OF THE INVENTION

The present invention relates to a baseball type of cap for a person, and, more particularly, to a cap that is usable to maintain the hair of the wearer away from the nape of the wearer's neck and yet which is easy and convenient to affix to the head of the wearer.

There are, of course, a considerable number of baseball type caps that are worn on the head of the wearer and which typically are constructed of a relatively flexible material and which also feature a brim or visor that extends outwardly from the front portion of the cap to provide shade to the eyes of the wearer and which visor is generally constructed of a relatively firm, self-supporting material.

With such caps, however, there is a difficulty with women having long hair, in that the hair extends outwardly from underneath the rear portion of the cap and down the nape of the wearer's neck and it would be preferred by some women, that the hair be directed by the cap itself to pass through the cap in such a manner that the hair is lifted away from the nape of the neck. As examples of such caps, there is shown and disclosed in U.S. Pat. No. 5,511,249 of Higgins, a head cap that has an opening in the upper central crown of the cap so that the hair of the wearer can emerge through the opening and is kept away from the nape of the wearer's neck.

As another example, there is also shown and described in U.S. Pat. No. 5,799,334 of Griffith et al, a ball type cap where there are a pair of openings at the upper sides of the cap so that a wearer can pass individual pigtails outwardly through the cap to provide management of those portions of the hair. There is a problem, however, with both the Higgins and the Griffith et al caps, in that it is often difficult as well as inconvenient for the wearer to have to manually thread the individual portions of the hair through the opening or openings in the cap and therefore the caps of Higgins and Griffith et al are somewhat difficult to don by the wearer. Thus, the threading of the portion of hair though the opening in the caps of Higgins and Griffith et al create an inconvenience to a wearer in placing the cap on the head and the caps cannot be quickly and easily be placed in the desired position atop of the head of the wearer.

On the other hand, there are wraps for the head that are easy to affix in place atop of the head and one is shown and described in U.S. Pat. No. 5,621,919 of Graham and which can readily be donned, however, the Graham hair wrap does not provide any hole to tightly enclose and control the hair to keep the hair off of the nape of the neck and, of course, there is no way to provide a visor on the Graham head wrap.

Accordingly, it would be advantageous to have a cap more acclimated for active wearers where it is desired to manage the hair by an opening in the cap to keep the hair off the nape of the wearer's neck and yet which can be put on quickly by wrapping the cap around the portion of hair, and the head of the wearer without any inconvenience and time consuming act of threading a portion of the hair through an opening in the cap.

SUMMARY OF THE INVENTION

The present invention provides an improved baseball type of cap that can be wrapped around the head of wearer to make the donning of the cap convenient and relatively easy and yet which has an opening to control a portion of the hair to pass through the cap generally upwardly and rearwardly through the crown portion of the cap and thus retain that portion of the hair off of the nape of the neck of the wearer.

The present cap is constructed of a flexible material such as felt, cotton or the like and includes a front portion where there is located a visor that extends outwardly from the front portion to provide shade for the eyes of the wearer. The cap also includes a pair of generally triangular shaped flaps that extend rearwardly from the front portion. The generally triangular shaped flaps each have lower edges and elongated inner edges. The elongated inner edges are preferably arcuate edges.

In one embodiment, there is a securing means that is provided to allow the wearer to affix the elongated inner edges together in fitting the cap to the head of the wearer and, when the elongated inner edges are affixed together, the cap fits about the wearer's head snugly forming a crown with an apex or uppermost point of the crown portion located atop of the wearer's head. There is also formed, a small opening at or proximate to the crown portion of the cap to allow a portion of the wearer's hair to pass through the cap in a outward and rearward direction so that the portion of that hair can pass through the opening and be raised or elevated with respect to the nape of the neck of the wearer.

In that embodiment, the securing means is provided at least substantially along the entire length of at least one of the elongated free inner edges of the cap, more preferably along the entire length of both of the elongated inner edges, and the securing means can be the conventional hook and loop type of fastening device marketed under the trademark Velcro, however, it will be seen that other types of securing means can be employed to affix the elongated inner edges of the flaps together in forming the cap about the head of the wearer.

Also, as is preferred, the elongated inner edges are arcuate such that when the elongated inner edges are affixed together in positioning the cap on the wearer's head, the junction between the edges forms an inward spiral in the direction of the crown portion of the cap such that the small tear drop shaped opening that is formed at or proximate the crown portion is located slightly rearward of the apex with the narrowed portion of the tear drop shape extending rearward therefrom, that is, away from the front portion of the cap where the visor is located, such that the hair is tightly enclosed within the small opening to control and direct the hair outwardly and rearwardly through the tear drop shaped small opening.

In another embodiment, the securing means is located along the lower edges of the flaps and the flaps substantially overlap each other to form a tear drop shaped opening at the top of the cap for the hair to pass through. In this embodiment, the securing means, which may be a hook and loop fastening system, extends substantially entirely along the lower edges of the generally triangular shaped flaps so that the bottom edges can be pulled tight to wrap the cap around the head of the wearer in forming the tear drop shaped opening for the hair.

As such, the elongated inner free edges in this embodiment overlap each other but are not affixed together since the location of the fastening means are affixed together in positioning the cap on the wearer's head and those elongated inner free edges form inward spirals with one inward spiral external and the other internal of the overlapped generally triangular shaped flaps. Again, however, as with the prior embodiment, the small tear drop shaped opening is formed at or proximate the crown portion and is located slightly rearward of the apex with the narrowed portion of the tear drop shape extending rearward therefrom, that is, away from the front portion of the cap where the visor is located, such that the hair is tightly enclosed within the small opening to control and direct the hair outwardly and rearwardly through the tear drop shaped small opening.

Other features of the present baseball type cap will become apparent in light of the following detailed description of a preferred embodiment thereof and as illustrated in the accompanying drawings.

DETAILED DESCRIPTION OF THE INVENTION

Figure 1:
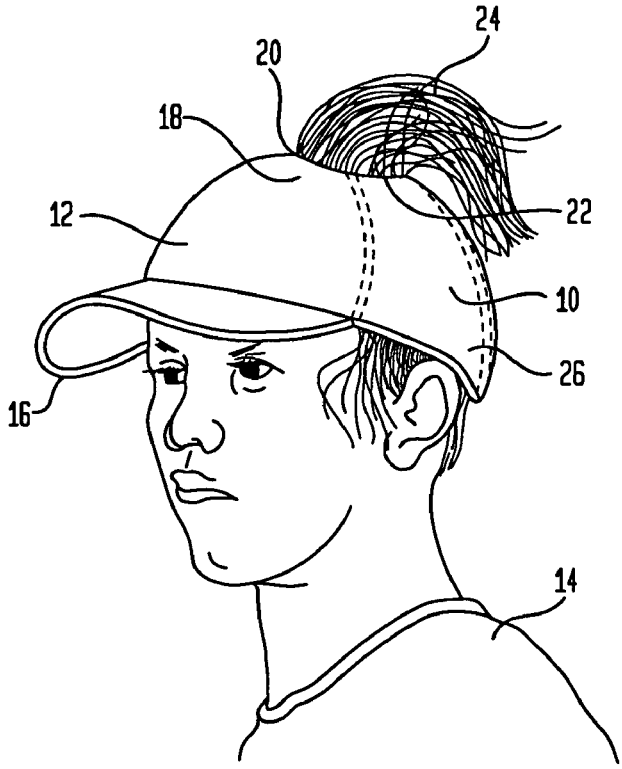
FIG. 1 is a perspective view of the baseball type cap of the present invention fitted to the head of a wearer.

Referring now to FIG. 1, there is shown a perspective view of the baseball type of cap 10 constructed in accordance with the present invention. As can be seen the cap 10 comprises a front portion 12 that faces frontward of the person 14 wearing the cap 10. A brim or visor 16 extends outwardly from the front portion 12 of the cap 10 in the forward direction so that the visor 16 can provide shade to the eyes of the person 14. The material for construction of the cap may be felt, plastic or any other material that is sufficiently flexible to be used in accordance with the following specification. The visor 16 can be constructed of a more rigid material but which still retains some flexibility.

As also can be seen in FIG. 1, the cap 10 is shaped so as to form a crown portion 18 having an apex 20 that is the uppermost point of the crown portion 18. At the crown portion 18, or proximate thereto, there is formed a small opening 22 through which the hair 24 of the person 14 passes so as to be directed upwardly and rearwardly by the small opening 22 that relatively tightly encircles the hair 24.

Figure 2:
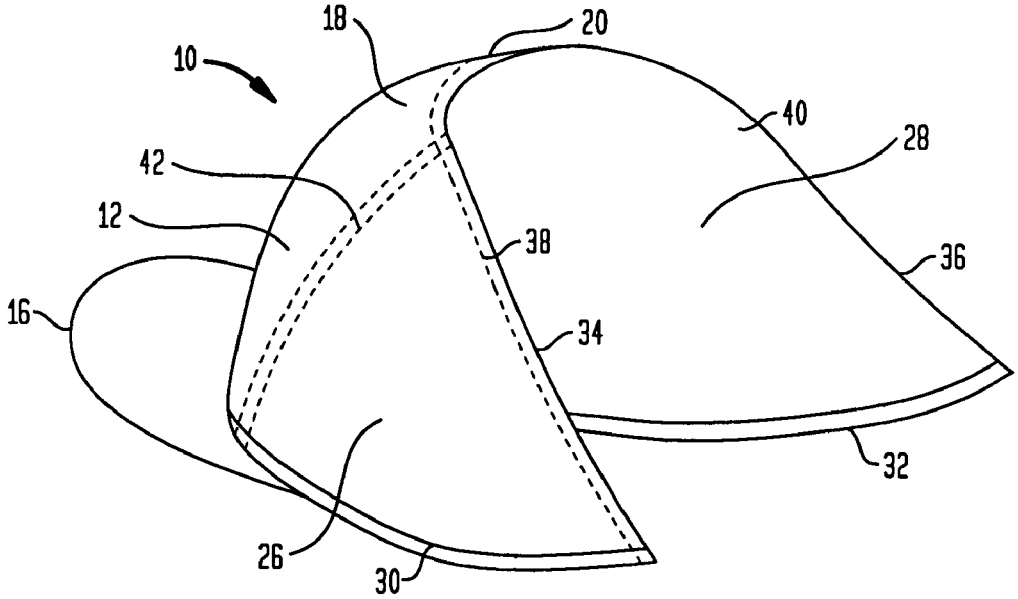
FIG. 2 is perspective rear quarter view of the present cap in its condition to be applied to the head of a wearer.

Turning now to FIG. 2, taken along with FIG. 1, there is shown a perspective view of the cap 10 in its state prior to being donned or worn by the person 14, that is, in its open orientation. In FIG. 2, the front portion 12 can be seen and also a pair of substantially triangular flaps 26, 28 that extend rearwardly from the front portion 12 or in the direction away from the extended visor 16. Each of the flaps 26, 28 has a lower edge 30, 32 that forms the bottom of the cap 10 and a free elongated inner edge 34, 36 facing towards each other.

The elongated inner edges 34, 36 are adapted to be affixed together along at least substantially the entire length of the elongated inner edges 34, 36 of the cap 10 to fit the cap 10 to the head of the person 14 in donning the cap 10. Accordingly, in the preferred embodiment there is a securing means that is located substantially, and preferably entirely, along the entire length of the elongated inner edges 34, 36 and such securing means can be a hook and loop system positioned along the elongated inner edges, shown as 38, 40 and which is available under the trademark Velcro. Alternatively, of course, the securing means may be a plurality of hooks, snaps, buttons or other means that can secure the elongated inner edges 34, 36 together. It is also preferred that the elongated inner edges 34, 36 be arcuate. FIG. 2 also shows a seam 42 that may be provided in the construction of the flap 24.

Figure 3:
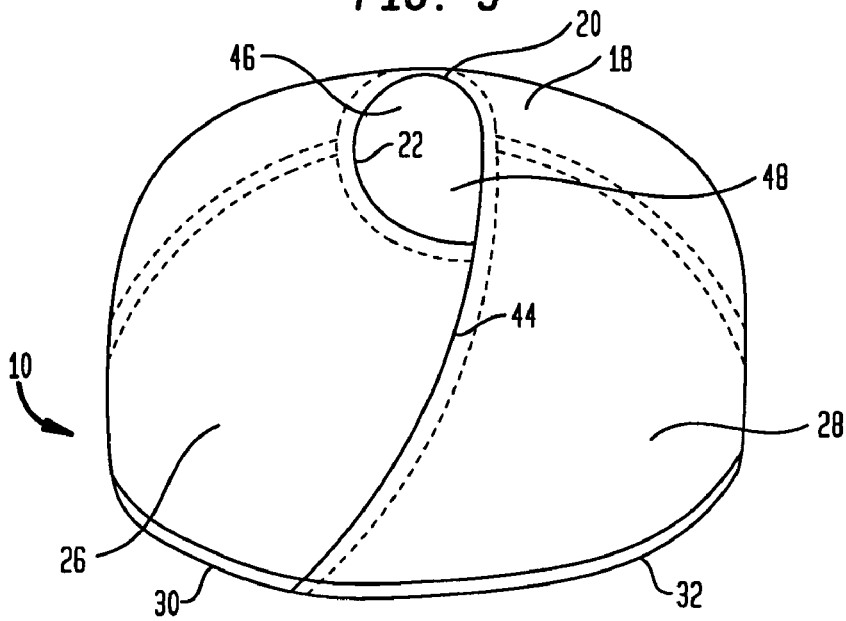
FIG. 3 is a rear view of the cap of the present invention.

Turning now to FIG. 3, taken along with FIGS. 1 and 2, there is shown a rear view of the baseball type cap 10 and showing the elongated inner edges 34, 36 of the flaps 26, 28 affixed together to form a junction 44 therebetween such as would be a normal step in placing the cap 10 atop of the head of the person 14. The junction 44 between the elongated inner edges 34, 36 form a generally inward spiral configured in the direction toward the crown portion 18 of the cap 10 so as to form the small opening 22. As can be seen, the small opening 22 is a tear drop shape having the widest portion 46 located at the front or in the direction toward the visor 16 and having the narrowed portion 48 facing rearwardly or toward the junction of the elongated inner edges 34, 36.

Figure 4:
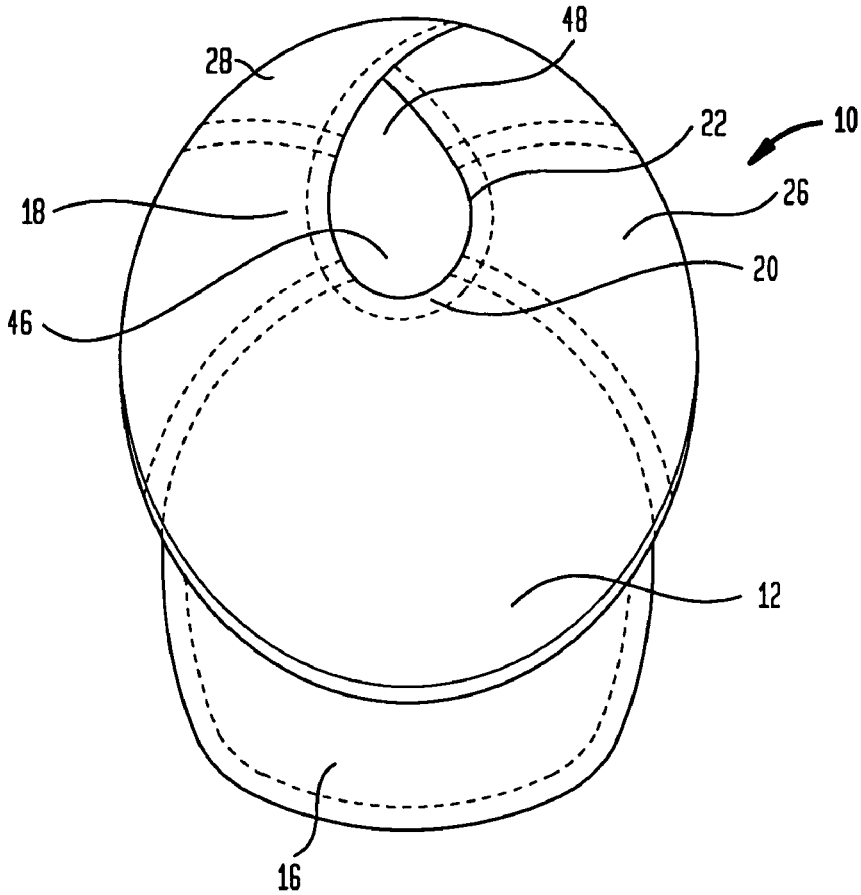
FIG. 4 is a top view of the cap of the invention.

Finally, turning now to FIG. 4, there is shown a top view of the baseball type cap 10 constructed in accordance with the present invention. In FIG. 4, the tear drop shaped small opening 22 is clearly shown and which is formed by the affixing together of the triangular flaps 26, 28 by the securing means to form the junction 44 in completing the construction of the cap 10. There are other seams 42 that are also shown and the cap 10 may or may not have the various seams or, if so, they may be in other locations about the surface of the cap 10.

In the use of the present baseball type of cap 10, it can be seen that the cap 10 can be easily donned by the person 14 since the cap 10 is simply wrapped around the head of the person 14 with the portion of hair extending upwardly through the small opening 22. As such, in placing the cap 10 atop of the head, it is not necessary to thread the hair through the small opening 22 since the cap 10 is wrapped in such a manner that the hair is surrounded by the cap 10 and elongated inner edges 34, 36 of the cap 10 are joined together to hold the portion of the hair 24 tightly within the small opening 22 to control and guide the hair 24 into the desired orientation.

Thus, the person 14 only needs to lean forward to allow the hair to cascade forwardly, wrap the cap 10 around the head and the hair, secure the cap 10 by affixing together the elongated inner edges 34, 36 of the generally triangular shaped flaps 26, 28 and then return to the full standing position so that the hair is captured within the small opening 22 easily and conveniently for the person 14.

Figure 5:
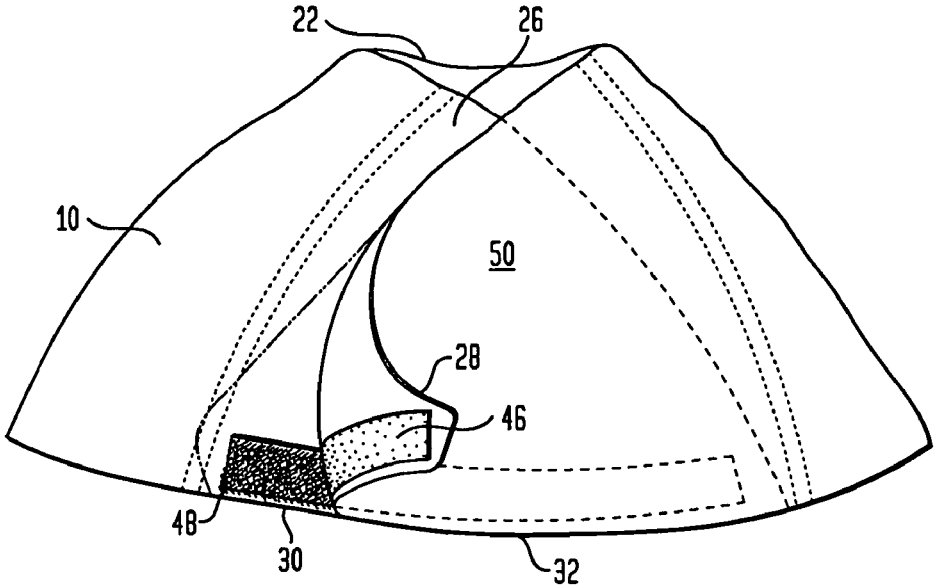
FIG. 5 is a rear view of the cap of an alternative embodiment of the present invention.

Turning now to FIG. 5, there is shown a rear view of the present cap 10 with one flap 28 partially open for illustrative purposes. In this embodiment, the hook and loop system, that is, the VELCRO fastening system is provided by means of the elongated strips 46, 48 located on the lower edges 30, 32 of the triangular shaped flaps 26, 28 and the triangular shaped flaps 26, 28 substantially overlap each other with a triangular shaped overlapping area 50 that is bounded by the overlap of the triangular shaped flaps 26, 28 such that the overlapping creates the tear drop shaped small opening 22. Thus, as can be seen, the hook and loop strips 46, 48 extend at least substantially, and preferably, fully along the lower length of the lower edges 30, 32 of the triangular shaped flaps 26, 28.

Figure 6:
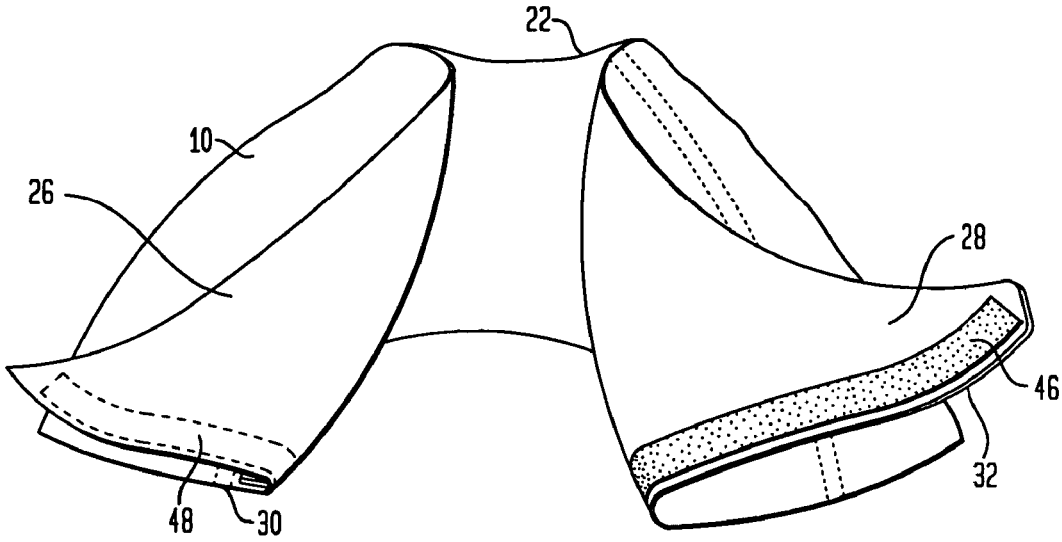
FIG. 6 is a rear view of the cap of FIG. 5 with the flaps of the cap in their open position to illustrate the fastening means.

In FIG. 6, taken along with FIG. 5, there also can be seen the extent of the overlapping of the present cap 10 by the triangular shaped flaps 26, 28 and the length of the hook and loop strips 46, 48. With the hook and loop strips 46, 48 in the secured position of FIG. 5, the lower edges 30, 32 of the triangular shaped flaps 26, 28 are contiguous to each other and which draws and wraps the cap 20 tightly around the head of the user to adjust to the head while leaving the tear drop shaped small opening 22 for the hair to pass therethrough.

Again in donning the cap 10 of this embodiment, the wearer only needs to lean forward to allow the hair to cascade forwardly, wrap the cap 10 around the head and the hair, secure the cap 10 by affixing together the elongated lower edges 30, 32 of the generally triangular shaped flaps 26, 28 and then return to the full standing position so that the hair is captured within the small opening 22 easily and conveniently for the person 14.

Since the lower edges 30, 32 have the hook and loop strips 46, 48, or other securing means extending at least substantially along the lower edges 30, 32 of each of the generally triangular shaped flaps 26, 28, it is possible to wrap the cap 10 around the head of the wearer to the extent it feels comfortable to the wearer and then use the securing means to retain the cap 10 with the desired tightness about the head while, at the same time, allowing the hair of the wearer to extend upwardly and rearward through the tear drop shaped opening 22. As such, the overlapping generally triangular flaps 26, 28 close around that hair to the extent desired by the wearer by the selecting the location of the lower edges 30, 32 of the generally triangular shape flaps 26, 28.

As such the tightness of the tear drop shaped opening 22 around the hair can be adjusted for the comfort as well as the amount of hair that extends therethrough by the wrapping procedure that allows the wearer to adjust the fit around the head as well as the size of the tear drop shaped opening 22. By the overlapping technique, therefore, the lower edges 30, 32 can be mated to achieve the overlapping effect to thereby create the tear drop shaped small opening 22 through which the hair can comfortably pass.

It will be understood that the scope of the invention is not limited to the particular embodiment disclosed herein, by way of example, but only by the scope of the appended claims.

I claim:

1. A baseball type cap for tightly encircling the hair of a person, said cap comprised of a flexible material and having a front portion comprising a visor extending outwardly from the front portion of the cap, said cap further having a pair of flaps extending rearwardly from the visor, said flaps each having inner edges and lower edges, said lower edges having elongated securing means comprising a hook and loop fastening system located and extending substantially along the entire length of said lower edges of said flaps, said elongated securing means adapted to join said lower edges together to cause the inner edge of one of said flaps to substantially overlap the inner edge of the other of said flaps to form the cap having a crown portion and to form a small opening proximate the crown portion configured to tightly encircle the hair of a person passing through the small opening.

2. A baseball type cap as defined in claim 1 wherein the flaps are generally triangular in shape.

3. A baseball type cap as defined in claim 1 wherein the lower edges are adapted to be secured together to form a contiguous elongated junction.

4. A baseball type cap as defined in claim 1 wherein the small opening is a tear drop shaped opening located proximate the crown portion of the cap and the size of the tear drop shaped opening is determined by the amount of overlapping of the flaps.

5. A method of affixing a baseball type cap to a person, said method comprising the steps of;

providing a cap having a front portion forming a visor and having a pair of flaps having elongated inner edges extending from the front portion and having lower edges, the lower edges having an elongated securing means comprising a hook and loop fastening system located and extending substantially along the entire length of the lower edges, placing the cap on the head of a person, arranging a portion of the hair of a person into an upward configuration, securing only the lower edges of the flaps together to substantially overlap said flaps to form a crown portion in the cap and to form an opening therein while positioning the portion of the hair to extend outwardly through the opening.

6. A method of affixing a baseball type cap to a person as defined in claim 5 wherein the step of securing the elongated inner ends together comprises forming a crown portion having a tear drop shaped opening therebetween.

7. A method of affixing a baseball type cap to a person as defined in claim 5 where the step of providing a cap comprises providing a cap having a pair of substantially triangular flaps.

8. A method of affixing a baseball type cap to a person as defined in claim 5 wherein the step of securing the lower edges of the flaps together comprises securing the lower edges in an elongated junction that extends along the entire length of the lower edges of said flaps.

9. A baseball type cap, said cap comprising a flexible material having a front portion forming a visor and having a pair of rearwardly extending flaps, each of the flaps having elongated inner edges and lower edges, an elongated securing means comprising a hook and loop fastening system located substantially along the entire length of said lower edges, said securing means detachably affixing the lower edges of the flaps to form a contiguous lower edge and to form a crown portion of the cap and to form an opening therein at or proximate to the crown portion, said opening configured to tightly encircle a portion of a person's hair passing through the opening.

10. A baseball type cap as defined in claim 9 wherein the rearwardly extending flaps are substantially triangular in shape.

11. A baseball type cap as defined in claim 9 wherein said lower edges are joined together to cause one of said flaps to substantially overlap the other of said flaps.

12. A baseball type cap as defined in claim 9 wherein said opening is a tear drop shaped opening.

13. A baseball type cap as defined in claim 12 wherein said tear drop shaped opening has a narrow portion extending rearwardly and its wider portion located toward the apex of the crown portion.

* * * * *